US005729994A

United States Patent [19]

Mukaiyama et al.

[11] Patent Number: 5,729,994

[45] Date of Patent: Mar. 24, 1998

[54] RADIATION TYPE AIR CONDITIONING SYSTEM HAVING DEW-CONDENSATION PREVENTING MECHANISM

[75] Inventors: Hiroshi Mukaiyama; Masayuki Cho; Tsuyoshi Rakuma, all of Oizumi-machi; Hiroyuki Takada; Syozo Kato, both of Ota, all of Japan

[73] Assignee: Sanyo Electric Co., Ltd., Osaka, Japan

[21] Appl. No.: 638,450

[22] Filed: Apr. 26, 1996

[30] Foreign Application Priority Data

Apr. 28, 1995 [JP] Japan ..... 7-129299
Jul. 31, 1995 [JP] Japan ..... 7-214028

[51] Int. Cl.[6] ..... F24F 1/00

[52] U.S. Cl. ..... 62/186; 62/160; 62/282; 62/198; 165/49

[58] Field of Search ..... 62/186, 272, 282, 62/82, 160, 324.5, 198, 199, 200, 196.4, 324.6, 324.1, 176.1, 176.6; 165/49, 904, 56, 57, 171, 168, 53

[56] References Cited

U.S. PATENT DOCUMENTS 3,905,203 9/1975 Jacob ..... 165/49 X
4,939,910 7/1990 Umezu et al. ..... 62/186 X
5,086,626 2/1992 Iida ..... 62/160 X
5,267,450 12/1993 Tagegawa et al. ..... 62/160 X

*Primary Examiner*—Harry B. Tanner
*Attorney, Agent, or Firm*—Darby & Darby

[57] ABSTRACT

In a radiation type air conditioning system for cooling or heating fluid such as air or refrigerant through heat exchange and supplying the cooled or heated fluid into a radiant panel to radiatively cool or heat a room, the air is cooled by a heat exchanger (evaporator), and the cooled air is supplied onto the radiation face of the radiant panel by a fan to prevent dew condensation on the radiation face of the radiant panel. If the air which is cooled and dried by the evaporator is heated by a heater when it is supplied onto the radiation face of the radiant panel, the dew condensation preventing effect can be enhanced. Further, plural through holes are formed in the radiation panel and the cooled air is blown out onto the radiation face through the through holes, so that the dew condensation preventing effect can be enhanced.

18 Claims, 4 Drawing Sheets

RADIATION TYPE AIR CONDITIONING SYSTEM HAVING DEW-CONDENSATION PREVENTING MECHANISM

BACKGROUND OF THE INVENTION

1. Field of the Invention

The present invention relates to a radiation type air conditioning system for cooling and/or heating a room (rooms) with using radiant heat of a radiant panel, and more particularly to a radiation type air conditioning system having a mechanism for preventing occurrence of dew condensation on the surface of a radiation panel.

2. Description of Related Art

A radiation type air conditioner having a radiant panel for emitting radiant heat has been hitherto known. This type of air conditioner is used while mounted on a wall, a ceiling or the like, and perform room cooling and/or heating operation by supplying cooled/dried or heated fluid into the radiant panel and cooling or heating a room with radiant heat emitted from the radiant panel. The radiant panel used for the radiation type of air conditioner as described above is mainly classified into two types. One type of radiant panel is used in such a way that air which has been passed through a heat exchanger by an air blower (fan) while cooled or heated by the heat exchanger is supplied to and circulated in the radiant panel, and a room (the indoor air) is cooled or heated with radiant heat of the cooled or heated air through the radiant panel. The other type of radiant panel is used in such a way that refrigerant which is cooled or heated while circulating in a refrigeration circuit is supplied to and circulated in the radiant panel, and a room (the indoor air) is cooled or heated with radiant heat of the cooled or heated refrigerant through the radiant panel. In the radiation type air conditioner using such a radiant panel as described above, the radiant heat can be supplied into the room without stirring (convecting) the indoor air by a fan under cooling or heating operation, so that a comfortable air conditioning atmosphere can be established in the room. In this specification, "heating operation with radiant heat emitted from the radiant panel" means that heat is transferred from the radiant panel to the indoor air due to thermal diffusion to thereby heat the indoor air, and "cooling operation with radiant heat emitted from the radiant panel" means that heat is transferred from the indoor air to the radiant panel due to thermal diffusion to thereby cool the indoor air.

In this type of air conditioner, when the radiant panel is kept at an excessively low temperature in cooling operation, the indoor air which is contacted with the surface of the radiant panel (hereinafter referred to as "radiation face") is cooled, and if the temperature of the cooled indoor air is reduced to a value lower than its dew point temperature, dew condensation occurs on the radiation face of the radiant panel and drops of dew fall down onto a floor, a carpet, etc. Therefore, the floor or the like may be finally wetted. Even when the radiant panel is not kept at an excessively low temperature, the dew condensation is liable to occur and thus the floor or the carpet may be also wetted if the humidity of a room is high, for example, in such a wet season as the rainy season.

In order to solve the above problem, the following methods have been proposed to prevent dew condensation on the radiation face of the radiant panel. One method is that grooves are formed on the radiation face of the radiant panel to collect drops of dew (moisture) occurring on the radiation face of the radiant panel and the collected drops of dew are discharged as drain along the grooves. The other method is that the radiant panel is formed of a ceiling board having moisture absorbing material and the drops of dew (moisture) occurring on the radiation face of the radiant panel are absorbed by the moisture absorbing material. However, the above two methods have the following disadvantages.

In the former method, the grooving design of the radiant panel is not matched with the interior of general houses, and further it is difficult to perform a grooving work. In the latter method, the moisture absorption amount (capability) of the moisture absorbing material has a limitation, and occurrence of mold is unavoidable. In this case, it may be considered that a dehumidifier, an air conditioner or the like is operated in a dry mode so that the humidity of the whole interior of the room is reduced. However, in such a situation that the dehumidifier, the air conditioner or the like must be used and operated in a cooling mode to defrost the interior of the room, the room is made excessively cold to make an user uncomfortable although the room is being under comfortable air conditioning operation by the radiant panel. In addition, use of both the radiant panel and the dehumidifier (or the air conditioner) makes a power cost high.

SUMMARY OF THE INVENTION

An object of the present invention is to provide a radiation type air conditioning system which can prevent occurrence of dew condensation on the surface of a radiant panel in room-cooling operation.

Another object of the present invention is to provide a radiation type air conditioning system which can enhance cooling power (capability), prevent occurrence of dew condensation on the surface of a radiant panel and also perform dry operation.

In order to attain the above objects, according to a first aspect of the present invention, a radiation type air conditioning system in which a radiant panel having a radiation face is supplied with fluid which is cooled or heated through heat exchange, and a room is cooled or heated with radiant heat of the cooled or heated fluid through the radiation face of the radiant panel, includes air cooling means for cooling air through heat exchange, and dew-condensation preventing air supply means for supplying the heat-exchanged cooled air to the periphery of the surface of the radiant panel to prevent occurrence of dew condensation on the radiation face of the radiant panel.

The radiation type air conditioning system of the first aspect of the present invention may be further provided with heating means for heating the air which has been cooled by the air cooling means.

According to a second aspect of the present invention, the radiation type air conditioning system of the first aspect of the present invention further includes a refrigeration circuit comprising a compressor, a condenser, an expansion device, a heat exchanger, a radiant panel and an evaporator, wherein the cooled or heated fluid is refrigerant which is circulated in the refrigeration circuit, and the room is cooled or heated with the radiant heat of the cooled or heated refrigerant through the radiant panel.

The air cooling means of the radiation type air conditioning system as described above may be the evaporator constituting the refrigeration circuit.

The radiation type air conditioning system of the second aspect of the present invention further includes an air blower for blowing air to the evaporator and the heat exchanger in this order, a bypass circuit through which the refrigerant bypasses the heat exchanger and/or the evaporator of the refrigeration circuit, and switch means for switching the bypass circuit.

The radiation type air conditioning system of the second aspect of the present invention further includes control means for allowing the refrigerant to flow into the heat exchanger, the radiant panel and the evaporator to cool the air and circulating the cooled air in the room by an air blower to convectively cool the room when room cooling operation is started, allowing the refrigerant to flow into the radiant panel while bypassing the heat exchanger and the evaporator to cool the room with the radiant heat from the radiant panel when a room temperature reaches a predetermined temperature, and allowing the refrigerant into the heat exchanger, the radiant panel and the evaporator while operating the heat exchanger to heat the air cooled by the evaporator to generate dried and heated air and blowing the dried and heated air onto the radiation face of the radiant panel by the air blower to prevent occurrence of dew condensation on the radiation face of the radiant panel.

The radiation type air conditioning system as described above may be designed so that at least the heat exchanger, the radiant panel and the evaporator are mounted in an indoor unit, and the other equipments are mounted in an outdoor unit.

The radiation type air conditioning system as described above may be constructed as a multiroom type air conditioning system for performing air conditioning (room-heating and/or room-cooling) operation in each room, by connecting a plurality of indoor units each having the same structure as the indoor unit as described above to the outdoor unit so that the outdoor unit and each of the indoor units constitute a refrigeration circuit.

In the radiation type air conditioning system as described above, the dew condensation preventing air supply means has plural through holes for blowing out the air which are formed in the radiant panel in a thickness direction of the radiant panel, and an air blower for blowing the cooled air through the through holes to the periphery of the radiation face of the radiant panel at the room side.

According to a third aspect of the present invention, the radiation type air conditioning system of each of the first and second aspects of the present invention, further includes room-air taking means for taking the indoor air from the room to blow the indoor air to the radiant panel, and a control mechanism for controlling the intake of the indoor air from the room when the indoor air is blown to the radiant panel, thereby varying (increasing or reducing) an amount of air to be blown out through the through holes.

The control mechanism controls the intake of the indoor air on the basis of the temperature difference between the temperature of the interior of the room (room temperature) and a desired temperature, or on the basis of the humidity of the interior of the room.

Further, according to a fourth aspect of the present invention, the radiation type air conditioning system of the first aspect of the present invention further includes a refrigeration circuit comprising a compressor, an outdoor heat rxchanger an expansion valve and an indoor heat exchanger, wherein the cooled or heated fluid is air which is heat-exchanged by the indoor heat exchanger, and the cooled or heated air is supplied into the radiant panel by the air blower to cool or heat the room with the radiant heat of the cooled or heated air through the radiant panel.

In the radiation type air conditioning system as described above, the indoor heat exchanger may comprise an evaporator. Further, a condenser for dry may be further provided at a downstream side of the evaporator.

In the radiation type air conditioning system as described above, the through holes are formed in the radiation face of the radiant panel.

The radiation type air conditioning system as described above may be designed so that at least the radiant panel and the evaporator are mounted in an indoor unit, and the other equipments are mounted in an outdoor unit.

The radiation type air conditioning system as described above may be constructed as a multiroom type air conditioning system for performing air conditioning (room-heating and/or room-cooling) operation in each room, by connecting a plurality of indoor units each having the same structure as the indoor unit as described above to the outdoor unit so that the outdoor unit and each of the indoor units constitute a refrigeration circuit.

As described above, according to the radiation type air conditioning system of the present invention, the air which is cooled by the air cooling means is supplied to the radiation face of the radiant panel by the dew condensation preventing air supply means, and the cooled air is kept as attached fluid on the radiation face of the radiant panel. Therefore, occurrence of dew condensation on the radiant panel particularly in the room-cooling operation, in the rainy season, etc. can be effectively prevented with no special equipment.

Further, the cooled air is once heated by the heating means disposed at the downstream side of the air cooling means to dry and heat the cooled air, and then the dried and heated air is supplied to the radiant panel, so that the occurrence of dew condensation can be more effectively prevented.

According to the radiation type of air conditioning system of the present invention, the bypass circuit is provided to the refrigeration circuit, and also the control means is further provided to control the refrigeration circuit so that the refrigerant is allowed to flow into the heat exchanger, the radiant panel and the evaporator to cool the air and the cooled air is circulated in the room by the air blower to convectively cool the room when the room cooling operation is started, the refrigerant is allowed to flow into the radiant panel while bypassing the heat exchanger and the evaporator to cool the room with the radiant heat from the radiant panel when the room temperature reaches a predetermined temperature, and the refrigerant is allowed to flow into the heat exchanger, the radiant panel and the evaporator while operating the heat exchanger to heat the air cooled by the evaporator to generate dried and heated air and the dried and heated air is blown out onto the radiation face of the radiant panel by the air blower to prevent occurrence of dew condensation on the radiation face of the radiant panel.

Further, the through holes through which the cooled air is blow out into the room are formed in the radiation face of the radiant panel, so that the cooled air can be effectively supplied to the periphery of the radiation face (the surface) of the radiant panel and the dew condensation can be effectively prevented. In addition, the cooled air which is blown to the periphery of the radiation face is also blown out to the room at the same time, so that the room can be more effectively cooled.

Still further, according to the present invention, when the air is supplied to the radiant panel, the indoor air is taken in by the indoor air taking means, and the intake of the indoor air is controlled by the control mechanism. In this case, if the intake of the indoor air is set to a large amount, the cooling power of the room can be enhanced. In addition, if the room-air intake is increased and the indoor air is supplied to the radiant panel, the air pressure in the room is lowered, resulting in an amount of air to be blown out through the radiant panel.

In order to perform dry operation, when the indoor air is taken and then supplied to the radiant panel, the indoor air may be cooled and dried by the evaporator before it is supplied to the radiant panel, and then returned to the room through the through holes of the radiant panel, whereby the dry operation can be effectively performed.

Further, according to the radiation type air conditioning system of the present invention, the intake of the indoor air is controlled on the basis of the temperature difference (load) between the room temperature and the preset temperature by the control mechanism. For example, the intake of the indoor air is increased as the load is larger, and reduced as the load is smaller, whereby comfortable air conditioning (heating or cooling) operation can be performed in accordance with the load.

Still further, according to the radiation type air conditioning system of the present invention, the intake of the indoor air is controlled by the control mechanism so that it is increased when the humidity of the room is higher than a predetermined level while it is reduced when the room humidity is lower than the predetermined level, whereby the dry operation can be performed in accordance with the room humidity.

If at least the heat exchanger, the radiant panel and the evaporator are mounted in an indoor unit and the other residual equipments are mounted in an outdoor unit, the present invention is applicable to a separation type air conditioner. Further, if plural indoor units thus constructed are connected to the outdoor unit, the present invention is applicable to a multiroom type air conditioning system for air-conditioning many rooms at the same time.

DETAILED DESCRIPTION OF PREFERRED EMBODIMENTS

Preferred embodiments according to the present invention will be described hereunder with reference to the accompanying drawings.

First, a first embodiment of the radiation type air conditioning system according to the present invention will be described with reference to FIGS. 1 to 4.

The first embodiment will be described on the case where the present invention is applied to a radiation type air conditioning system having such a type of radiant panel that cooled or heated air is supplied to and circulated in the radiant panel, and a room is cooled or heated with radiant heat emitted from the air through the radiant panel. However, it is needless to say that the same effect as this embodiment can be obtained by applying this embodiment to a radiation type air conditioning system using the other type of radiant panel.

Figure 1:
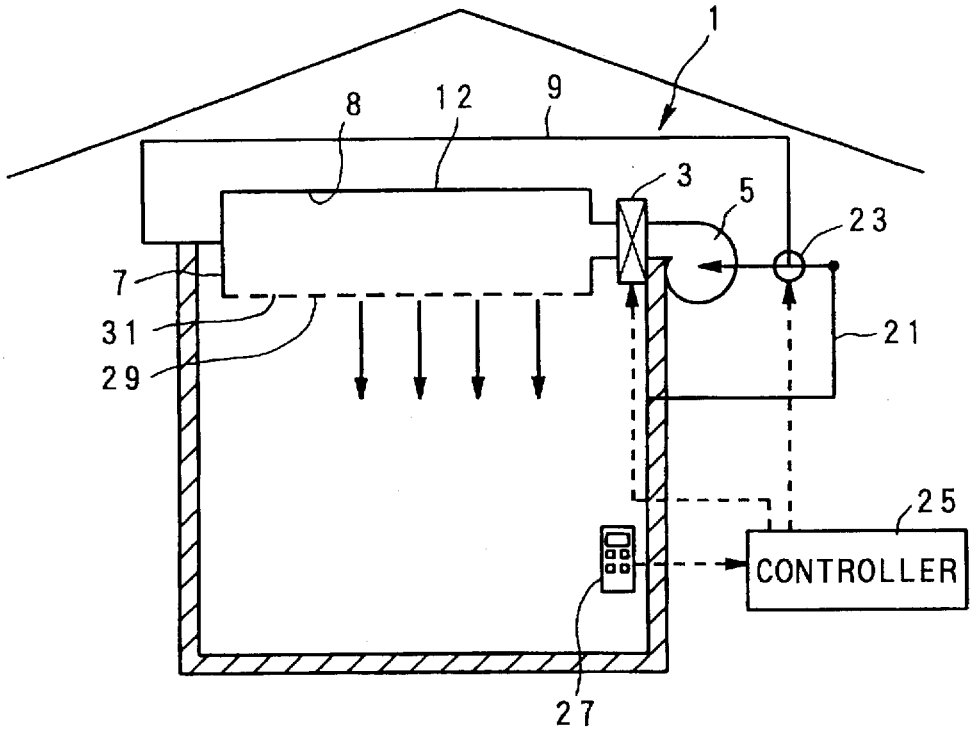
FIG. 1 shows a first embodiment of a radiation type air conditioning system of the present invention.

FIG. 1 shows a basic construction of the radiation type air conditioning system of the first embodiment.

As shown in FIG. 1, the radiation type air conditioning system has a radiation type air conditioner 1, and the radiation type air conditioner 1 has a cooler (heater) 3, an air blower (fan) 5, a radiant panel 7 which is mounted on a ceiling or the like, and a panel circulating duct 9 which connects the above elements to one another. The cooler (heater) 3 is an indoor heat exchanger in a refrigeration cycle shown in FIG. 2, and it operates as an evaporator in cooling operation and as a condenser in heating operation.

Figure 2:
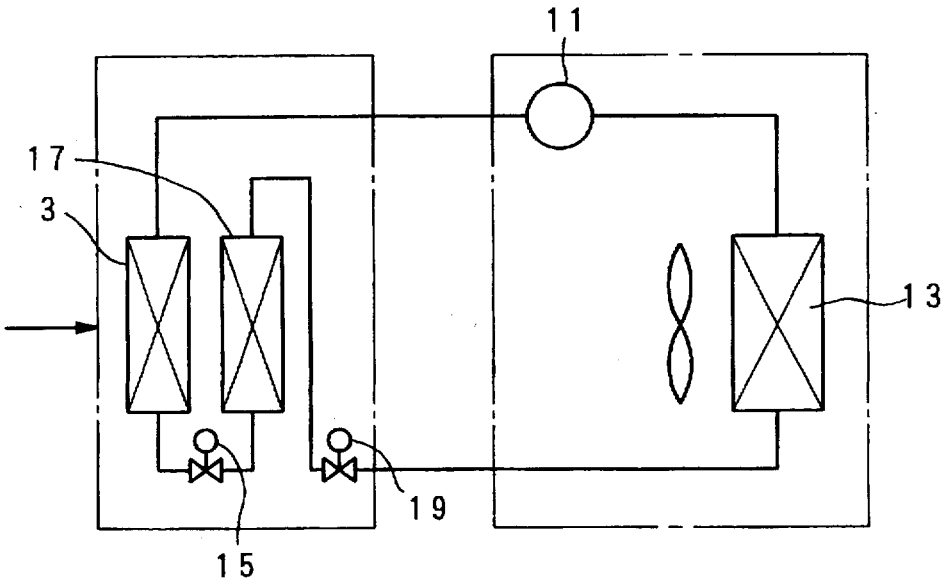
FIG. 2 is a circuit diagram showing a refrigeration cycle used in the radiation type air conditioning system shown in FIG. 1.

FIG. 2 shows a refrigeration cycle used for the radiation type air conditioning system shown in FIG. 1.

As shown in FIG. 2, the refrigeration cycle basically includes a compressor 11, an outdoor heat exchanger 13, an expansion valve 19 and an indoor heat exchanger 3. In this embodiment, another heat exchanger 17 (operating as a second cooler (heater)) and an expansion valve 19 which are used for dry operation are further disposed in the refrigeration cycle. Accordingly, the radiation type air conditioning system of this embodiment has not only a cooling/heating function, but also a dry function.

In dry operation, the air which is blown by the air blower is passed through the heat exchanger 3 operating as an evaporator and the heat exchanger 17 operating as a condenser in this order. That is, the air is cooled by the evaporator 3 to remove water from the air, and then the cooled air is heated by the condenser 17 to return the temperature of the cooled air to the original temperature with keeping its humidity.

The panel circulating duct 9 is connected to the air blower 5 so that the air in the radiant panel 7 is fed through the panel circulating duct 9 to the indoor heat exchanger 3 and then returned to the radiant panel 7. In this embodiment, a indoor circulating duct 21 for taking the indoor air from a room and supplying the indoor air to the air blower 5, and a change-over valve 23 serving as a control mechanism for controlling the intake of the indoor air by the indoor air circulating duct 21 are connected to the panel circulating duct 9 before the panel circulating duct 9 is connected to the air blower 5.

In this embodiment, the change-over valve 23 is designed to freely vary the intake of the indoor air (for example, it may be AN opening/closing valve in which its opening degree is freely variable). However, it may be designed to perform only ON/OFF operation (that is, it is allowed to have only two switching states where it is fully opened and where it is fully closed).

The change-over valve 23 is connected to a controller 25, and the opening degree of the change-over valve 23 is controlled by the controller 25. Accordingly, the change-over valve 23 varies the intake of the indoor air in accordance with an opening-degree signal from the controller 25. The controller 25 is also connected to the expansion valve 19, and the opening degree of each of the change-over valve 23 and the expansion valve 19 is controlled in accordance with a required cooling load or a dry degree by the controller 25.

Further, a remote controller (remote controller switch) 27 is provided in a room to set a room temperature and select one of operation modes such as a cooling mode, a heating mode, a dry mode, etc., and a temperature sensor and a humidity sensor are built in the remote controller 27 to detect the actual temperature and humidity in the room, and the detected temperature and humidity are transmitted to the controller 25 as detection signals.

In the cooling operation, the radiant panel 7 is supplied with the cooled air which is passed through the evaporator 3 by the air blower while cooled by the indoor heat exchanger 3 serving as the evaporator, whereby the radiant panel 7 is cooled by the supplied cooled air. At this time, the indoor air is also cooled with radiant heat of the cooled radiant panel 7. On the other hand, in the heating operation, the radiant panel 7 is supplied with the heated air which is passed through the indoor heat exchanger 3 serving as the condenser by the air blower while heated by the condenser 3, whereby the radiant panel 7 is heated by the supplied heated air. At this time, the indoor air is also heated with radiant heat of the heated radiant panel 7.

As shown in FIG. 1, the radiant panel 7 is designed to have a cavity 8 therein (that is, the radiant panel 7 has a hollow structure), and the cooled (heated) air passing through the indoor heat exchanger 3 is supplied into the cavity 8 by the air blower 5.

The radiant panel 7 comprises a box-shaped housing 12 having an open portion, which is formed of highly heat-insulating material, and a surface member (radiation face) 29 which is formed of pure aluminum or aluminum alloy at the open portion. As shown in FIG. 1, many through holes 31 through which the cooled (heated) air is blown out to the outside are formed substantially in the whole area of the surface member (radiation face) 29 of the radiant panel 7 in the thickness direction of the panel. The through holes 31 are preferably formed in the radiation face 29 so as to have a diameter of 1mm or less and so as to be arranged at an interval of 10mm or less. Particularly in cooling operation, occurrence of dew condensation can be effectively prevented by the cooled air blown out through these through holes 31.

Next, the operation of the radiation type air conditioning system, particularly in the cooling operation, will be described in detail.

In normal radiative cooling operation, the change-over valve 23 is controlled so that the indoor air circulating duct 21 is closed and only the panel circulating duct 9 is opened. In this case, the indoor air is not taken into the radiant panel 7 by the indoor air circulating duct 21, and only the air from the panel circulating duct 9 is supplied to the radiant panel 7. The air which is supplied to the indoor heat exchanger 3 operating as the evaporator (cooler) by the air blower 5 is cooled by the indoor heat exchanger 3, and then the cold air is supplied into the cavity 8 of the radiant panel 7. In the radiant panel 7, the radiation face 29 is cooled by the cold air, and the room is gradually cooled by the radiant heat of the cold air (i.e., the heat of the indoor air is gradually transferred to the cold radiant panel 7 due to thermal diffusion).

When the surface of the radiation face 29 is uniformly covered with the cold air, occurrence of dew condensation on the surface of the radiation face 29 can be suppressed even if the cold air in the cavity 8 is set to a temperature lower than the dew point temperature of the indoor air. Further, the surface of the radiation face 20 is cooled by both the cold air blown out from the through holes 31 and the cold air circulating in the cavity 8, so that the surface temperature of the radiation face 29 can be kept to a value near to the temperature of the cold air and thus the cooling operation can be effectively performed with the radiant heat of the radiant panel.

In addition, the cold air is uniformly blown out onto the surface of the radiant panel 7 from the substantially whole surface of the radiation face 29 through a large number of small-diameter through holes 31 in the cooling operation, and thus the cold air covers the surface of the radiation face 29 as if it adheres to the surface of the radiation face 29. Therefore, the indoor air is pushed away from the surface of the radiation face 29, and the surface of the radiation face 29 is uniformly covered by the cold air. Further, the cold air which is blown out through the through holes 31 are also diffused into the room, and it also contributes the cooling operation of the room.

At the start time of the cooling operation, fast cooling operation is needed when the temperature difference between a set temperature and an actual room temperature is above a predetermined value T0. In this case, the opening degree of the change-over valve 23 is adjusted by a predetermined amount in accordance with a required load to open the indoor air circulating duct 21, whereby the indoor air is introduced into the radiant panel 7. The introduced indoor air is cooled by the cooler (evaporator) 3 and then blown out from the through holes 31 Of the radiation face 29 to the room. Accordingly, the cold air is positively supplied to the room, and thus the room can be positively cooled like an air conditioner which cools the room by blowing out the cold air to the room. Therefore, the radiation type air conditioning system of this embodiment has the excellent rise-up characteristic of the cooling operation, and provides a comfortable cooled atmosphere.

If the intake of the indoor air is increased when the cold air is supplied to the radiant panel 7, the room cooling power can be enhanced. In addition, the pressure of the indoor air is reduced at the same time, and the amount of the cold air to be blown out from the through holes 31 is also increased.

Further, the indoor air in the vicinity of the surface of the radiation face 29 of the radiant panel 7 is pushed away from the surface of the radiation face 29 by the cold air which is discharged through the through holes of the radiant panel to the room, and also the surface of the radiation face 29 is adhesively covered with the cold air (attached fluid), so that the dew condensation on the radiation face 29 can be surely prevented.

In dry operation, the indoor air is taken by the indoor air circulating duct 21 when the air is supplied to the radiant panel 7, and then cooled and dried by the cooler (evaporator) 3. Thereafter, the cooled and dried air is re-heated by the heat exchanger 17 operating as the condenser so that the temperature of the cold air is returned to the original temperature with keeping its humidity, and then the dried air is returned to the room through the through holes 31 of the radiant panel 7. In this specification, "re-heat" means that the air which has been cooled by the cooler is heated by heating means such as a heat exchanger or the like so that the temperature of the cooled air is returned to its original temperature.

Next, the control operation of the controller 25 will be described.

Figure 3:
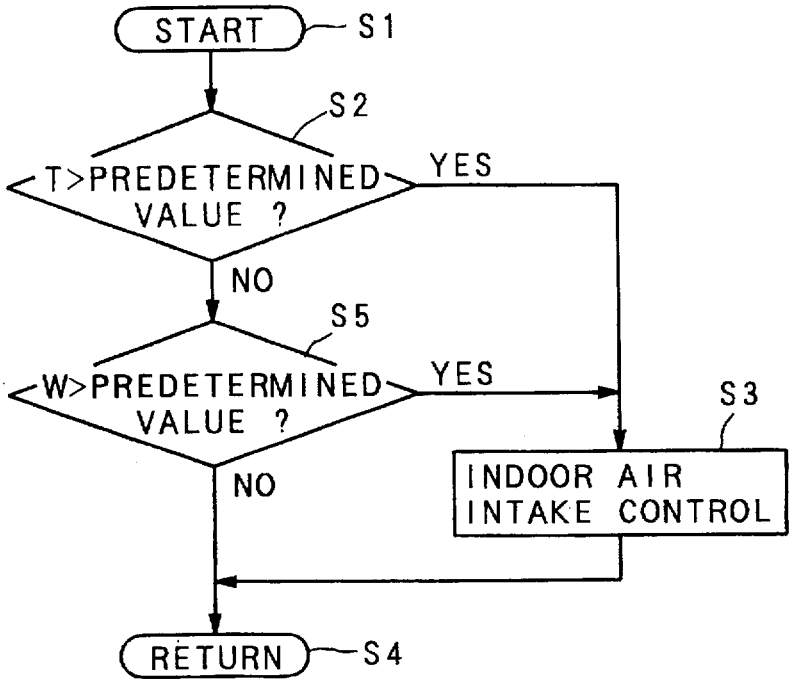
FIG. 3 is a modification of the refrigeration cycle of FIG. 2.

As shown in FIG. 3, upon start of the control process in step S1, the control process goes to step S2 in which the controller 25 receives temperature signals representing a set temperature and a room temperature from the remote controller to compare the set temperature and the actual room temperature, and judges whether the temperature difference T between the set temperature and the actual room temperature is larger than a predetermined value T0. If the temperature difference T is larger than the predetermined value T0, the process goes to step S3 to perform the room-air intake control. The room-air intake control is preferably performed by freely varying the opening degree of the change-over valve 23 in proportion to the temperature difference, however, it may be performed by selectively setting the indoor air circulating duct 21 to one of the two states (open and close states).

In the case where the intake of the indoor air is controlled in proportion to the temperature difference (load) between the room temperature and the demanded set temperature, the intake of the indoor air is increased if the load is large, and reduced if the load is small, whereby a comfortable cooling or drying atmosphere can be achieved in accordance with the load.

The predetermined value t0 as described above is preferably set to 25° C. to 35° C., and in this embodiment it is set to 30° C.

On the other hand, if the temperature difference T between the set temperature and the room temperature is not larger than the predetermined value T0 in step S2, the process goes to step S5 to judge whether the humidity difference W between a set humidity and an actual room humidity is larger than a predetermined value W0.

If the humidity difference W is larger than the predetermined value W0, the process goes to step S3 to perform the room-air intake control. The room-air intake control may be performed by freely varying the opening degree of the change-over valve 23 in proportion to the humidity difference W, or by selectively setting the indoor air circulating duct 21 to one of the two states (open and close states) like the case of the temperature control as described above.

The predetermined value W0 is preferably set to 60% to 90%, and in this embodiment it is set to 80%.

After the room-air intake control is performed in step S3, the process goes to step S4 to return to the start step S1.

The present invention is not limited to the above embodiment, and various modifications may be made without departing from the subject matter of the present invention.

Figure 4:
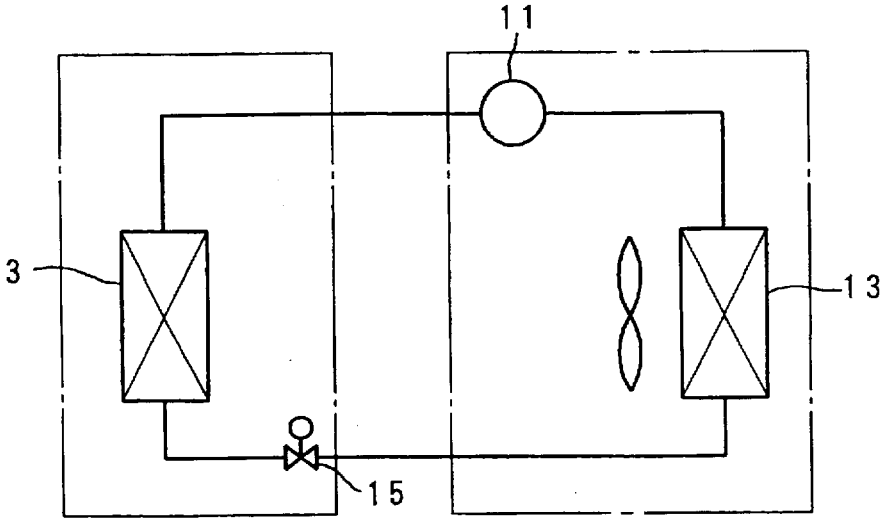
FIG. 4 is a flowchart showing a control flow of a controller.

For example, the refrigeration cycle of the above embodiment is equipped with two heat exchangers 3 and 17, however, the refrigeration cycle may be equipped with only the heat exchanger (cooler) 3 as shown in FIG. 4. That is, no heat exchanger for reheating the cooled air may be provided. In this case, the room-air intake control is performed on the basis of the temperature control because the humidity control cannot be carried out.

As described above, according to the present invention, the intake of the indoor air which is to be supplied to the radiant panel is controlled in accordance with a required load. If the required load is high, the intake of the indoor air is increased to positively blow out the cold air from the through holes of the radiant panel to the room, thereby enhancing the cooling power. In this case, the pressure of the indoor air is reduced because the room-air intake is increased to supply the air to the radiant panel, and thus the air amount to be discharged through the through holes of the radiant panel is increased.

Further, the indoor air which is approaching to the surface of the radiation face is pushed away from the surface of the radiation face by the cold air which is discharged to the room through the through holes of the radiant panel, and the cold air creeps along the surface of the radiant face, so that the dew condensation on the surface of the radiation face can be surely prevented.

In the dry operation, when the air is supplied to the radiant panel, the indoor air is taken from the room, cooled and dried through the heat exchange by the heat exchanger and then return to the room through the through holes of the radiant panel. Therefore, the dry operation can be effectively performed.

Further, the intake of the indoor air is controlled on the basis of the temperature difference (load) between the room temperature and the set temperature, so that the comfortable cooling or heating atmosphere can be obtained in accordance with the load.

Still further, the intake of the indoor air is controlled by the change-over valve 23 so that it is increased when the room humidity is higher than the predetermined value, and reduced when the room humidity is lower than the predetermined value. Therefore, the dry operation can be effectively performed in accordance with the humidity in the room.

Next, a second embodiment of the radiation type air conditioning system of the present invention will be described with reference to FIGS. 5 and 6.

Figure 5:
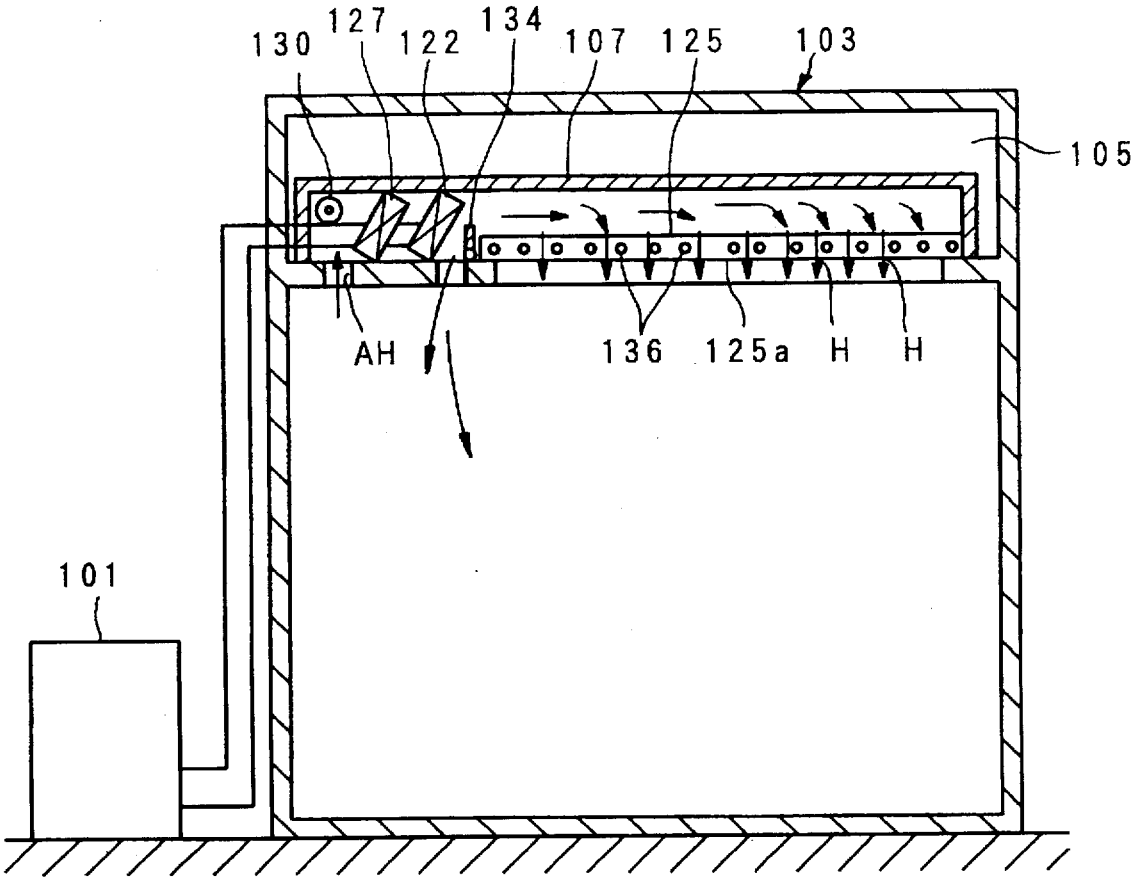
FIG. 5 shows a second embodiment of the radiation type air conditioning system of the present invention.
Figure 6:
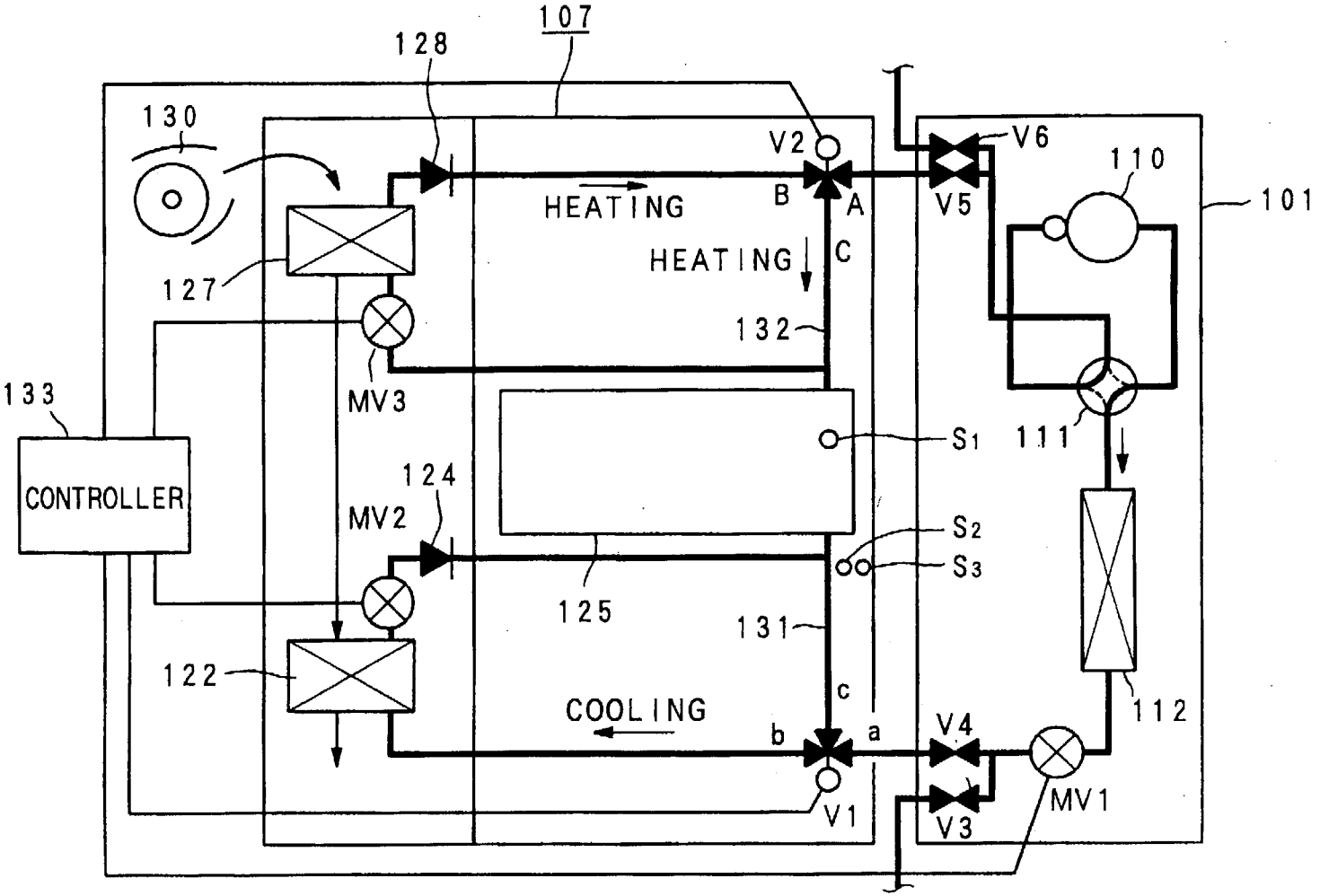
FIG. 6 is a circuit diagram showing a refrigeration cycle used in the radiation type air conditioning system shown in FIG. 5.

FIG. 5 shows the second embodiment of the radiation type air conditioning system of the present invention, and FIG. 6 shows a refrigeration circuit used by the radiation type air conditioning system shown in FIG. 5.

The second embodiment will be described on the case where the present invention is applied to a radiation type air conditioning system having such a type of radiant panel that cooled or heated refrigerant which is circulates in a refrigeration circuit is supplied to the radiant panel, and a room is cooled or heated with radiant heat emitted from the refrigerant through the radiant panel. However, it is needless to say that the same effect as this embodiment can be obtained by applying this embodiment to a radiation type air conditioning system using the other type of radiant panel.

In FIG. 5, reference numeral 101 represents an outdoor unit, and reference numeral 107 represents an indoor unit. The indoor unit 107 is mounted on a ceiling 105 of a housing 103, and it is connected to the outdoor unit 101 through refrigerant pipes.

As shown in FIG. 6, in the outdoor unit 101 are mounted a compressor 110, a four-way valve 111, an outdoor heat exchanger 112, and an expansion device (first electronic expansion valve) MV1, and in the indoor unit 107 are mounted a first three-way valve V1, an indoor heat exchanger 122, a second electronic expansion valve MV2, a check valve 124, a radiant panel, 125, a third electronic expansion valve MV3, an indoor heat exchanger 127, a check valve 128, a second three-way valve V2, a fan 180 for blowing air to the heat exchangers 127 and 122 in this order (that is, the heat exchanger 127 is disposed at the upstream side of the heat exchanger 122 with respect to the fan 180), and a damper 134 (see FIG. 5). During cooling operation, the outdoor heat exchanger 112 operates as a condenser, and the indoor heat exchanger 127 operates as an evaporator.

A refrigerant pipe is formed in the radiant panel 125 so as to be extended in a meandering form, for example. If the refrigerant pipe 136 operates as a heat absorber (i.e., cold refrigerant flows in the refrigerant pipe 136), radiative cooling operation is performed through a radiation face **125*a* of the radiant panel 125** at the indoor side.

As shown in FIG. 6, the refrigeration circuit of this embodiment is further provided with a first bypass circuit 131 for bypassing the heat exchanger 122, the second electronic expansion valve MV2 and the check valve 124. One end of the first bypass circuit 131 is connected to the first three-way valve V1, and the other end thereof is connected to the radiant panel 125. Further, the refrigeration circuit is further provided with a second bypass circuit 132 for bypassing the third electronic expansion valve MV3, the heat exchanger 127 and the check valve 128. One end of the second bypass circuit 132 is connected to the radiant panel 125, and the other end thereof is connected to the second three-way valve V2. In FIG. 6, reference numeral 133 represents a controller.

Next, the operation of the radiation type air conditioning system of this embodiment, particularly in the cooling start operation, will be described in detail. As described above, in the cooling operation, the heat exchanger 112 operates as the condenser, and the heat exchanger 127 operates as the evaporator. The radiation type air conditioning system of this embodiment has the following features particularly in cooling operation.

(1) In consideration of the fact that a room is usually warm at the start time of the cooling operation, the fan 130 is first driven to forcedly blow the cold air to the room so that the room is rapidly cooled by forced convection.

At this time, the pressure-reduced refrigerant is allowed to flow through the heat exchanger 122, the radiant panel 125 and the evaporator 127 to use these three units as coolers. That is, referring to FIG. 6, the controller 133 performs its control operation so that the four-way valve 111 is switched to the position as indicated by a solid line, the ports a and b of the first three-way valve V1 intercommunicate with each other, the ports A and B of the second three-way valve V2, the first electronic expansion valve MV1 is closed, and the second and third electronic expansion valves MV2 and MV3 are fully opened. In addition, referring to FIG. 5, the controller 133 controls the damper 134 in the indoor unit 107 to be erected as indicated by a dotted line. With this control operation, the refrigerant flows through the compressor 110, the four-way valve 111 and the condenser 112 to radiate heat from the condenser 112 to the outside. Thereafter, the refrigerant is reduced in pressure by the first electronic expansion valve MV1, then allowed to flow through the heat exchanger 122, the radiant panel 125 and the evaporator 127 in this order to absorb the heat of the air (cool the room), and then returned to the compressor 110.

In this case, each of all the heat exchanger 122, the radiant panel 125 and the evaporator 127 operates as an evaporator (cooler). Accordingly, when the fan 130 is driven, the air which is blown by the fan 130 is strongly cooled by the evaporator 127, the heat exchanger 122 and the radiant panel 125 to rapidly cool the room by forced convection as indicated by solid lines of FIG. 5.

(2) Referring to FIG. 6, the surface temperature of the radiant panel 125 is monitored by a temperature sensor S1 during cooling operation, and the dew point temperature in the neighborhood of the radiant panel 125 is calculated on the basis of detection values of temperature sensors (or absolute humidity sensors) S2 and S3 located in the neighborhood of the radiant panel 125.

(3) When the room temperature reaches a predetermined temperature after the control operation at the start time of the cooling operation (1) as described above is performed, the heat exchanger 122 and the evaporator 127 are bypassed by the first and second bypass circuits 131 and 132 so that the refrigerant is allowed to flow through only the refrigerant pipe 136 of the radiant panel 125 to perform the radiative cooling operation.

That is, the controller 133 performs its control operation so that the first electronic expansion valve MV1 is closed, the ports a and c of the first three-way valve V1 intercommunicate with each other, and the ports A and C of the second three-way valve V2 intercommunicate with each other. Accordingly, the refrigerant flows through the compressor 110, the four-way valve 111 and the condenser 112 to radiate the heat of the refrigerant to the outside, and then flows through the first bypass circuit 131 into the radiant panel 125 to absorb the heat of the indoor air (cool the indoor air) while bypassing the heat exchanger 122. Thereafter, the refrigerant flows through the second bypass circuit 132 and returns to the compressor 110 while bypassing the evaporator 127. In this case, the fan 130 is stopped. Accordingly, the indoor air is not convected by the fan 130, and thus a comfortable air conditioning atmosphere can be achieved by only the radiant panel 125.

(4) When the temperature detected by the temperature sensor S1 (2) is substantially equal to the calculated dew point temperature in the neighborhood of the radiation panel 125, the following dew condensation preventing control operation is started to prevent occurrence of dew condensation on the radiation face 125*a* of the radiant panel 125.

That is, the controller 133 performs its control operation so that the ports a and b of the first three-way valve V1 intercommunicate with each other, the ports A and B of the second three-way valve V2 intercommunicate with each other, the first electronic expansion valve MV1 is fully opened, and the second and third electronic expansion valves MV2 and MV2 are closed. With this control operation, the refrigerant is allowed to flow through the compressor 110, the four-way valve 111, the condenser 112 and the heat exchanger 122 to radiate the heat of the refrigerant, and then reduced in pressure by the second electronic expansion valve MV2. The pressure-reduced refrigerant is passed through the radiant panel 125, and then further reduced in pressure by the third expansion electronic valve MV3 until its temperature is set to an evaporation temperature at which it can be dried. The pressure-reduced refrigerant flows through the evaporator 127 to absorb the heat of the air (dry the indoor air) and then returns to the compressor 110.

In this case, the heat exchanger 122 operates as heating means, and each of the radiant panel 125 and the evaporator 127 operates as an evaporator. Accordingly, if the fan 130 is driven, the air which is cooled and dried by the evaporator 127 is re-heated (heated after cooled) by the heat exchanger (heating means) 122, and then the dried and re-heated air is supplied to the radiant panel 125. The supplied air is kept as attached fluid on the radiation face 125*a* of the radiant panel 125, so that the dew condensation on the radiation face 125*a* of the radiant panel 125 can be prevented like the first embodiment. In this case, the dumper 134 of FIG. 5 is closed. Further, the opening degree of the third electronic expansion valve MV3 and the rotational number of the compressor 110 are monitored and adjusted to proper values so that the temperature of the dried and re-heated air is kept to a proper temperature and the sucking pressure of the compressor 110 is kept to a proper pressure.

In the above control process, the operation (1) may be omitted.

(5) In heating operation, the controller 133 controls the four-way valve 111 to be switched as indicated by a dotted line of FIG. 6. In this case, the outdoor heat exchanger 112 serves as an evaporator, and the refrigerant flows through only the bypass circuits 132 and 131, so that the radiative heating operation is performed by only the radiant panel 125.

The present invention is not limited to the above embodiment, and various modifications may be made without departing from the subject matter of the present invention.

For example, through holes H as shown in FIG. 5 may be formed in the radiant panel 125 so as to penetrate through the radiant panel 125 in the thickness direction thereof. In this case, the cooled air which is blown by the fan 130 is blown out through the through holes H onto the radiation face as indicated by arrows of FIG. 5, whereby the dew condensation on the radiation face of the radiant panel can be effectively prevented like the first embodiment as described above.

Further, as shown in FIG. 5, a indoor air intake portion (AH) and a room-air intake control mechanism which are similar to those of the first embodiment may be provided to have the same effect as the first embodiment.

Referring to FIG. 6, when the radiation type air conditioning system as described above is constructed so that the indoor unit 101 and the outdoor unit 107 are connected to each other through service valves V4 and V5, and at least the heat exchanger, the radiant panel and the heat exchanger (operating as the evaporator under cooling operation) are mounted in the indoor unit while the other equipments are mounted in the outdoor unit 101 as shown in FIG. 6, this radiation type air conditioning system may be connected to another indoor unit 107 through other service valves V3 and V6.

For a radiation type air conditioning system having such a radiant panel as described above, it is known as being efficient to continuously drive the radiant panel for a long time. In this sense, it is favorable that one outdoor unit 101 is connected plural indoor units 107 to construct a multi-room radiation type air conditioning system.

As is apparent from the foregoing description, according to this embodiment, the heating means is provided to temporarily heat the air cooled by the evaporator and supply the dried and re-heated air to the radiant panel. Therefore, the dried and reheated air is kept as attached fluid on the radiation face of the radiant panel, thereby enhancing the effect of preventing the dew condensation on the radiation face of the radiant panel.

Furthermore, according to this embodiment, not only the evaporator, but also the heat exchanger is provided to temporarily heat the air cooled by the evaporator and supply the dried and re-heated air. Therefore, the dried and re-heated air is kept as attached fluid on the radiation face of the radiant panel, thereby more greatly enhancing the effect of preventing the dew condensation on the radiation face of the radiant panel.

Still furthermore, at the start time of the cooling operation, the air which has been cooled by allowing the refrigerant to flow through the heat exchanger 122 operating as an evaporator, the radiant panel 125 and the evaporator 127 is convectively blown into the room by the fan 130 to perform the convective room cooling operation, so that the rapid cooling operation can be performed.

In this case, when the room temperature reaches a predetermined temperature, the refrigerant is allowed to flow through the radiant panel while bypassing the heat exchanger 122 and the evaporator 127 to perform the radiative cooling operation. Therefore, a comfortable air conditioning atmosphere can be established without stirring (convecting) the air by the fan. Further, when the humidity in the room reaches a predetermined humidity, the refrigerant is allowed to flow through the heat exchanger 122 serving as a heater, the radiant panel and the evaporator, and the air cooled by the evaporator 127 is re-heated by the heat exchanger 122 to generate dried and re-heated air. The dried and re-heated air is blown onto the radiation face of the radiant panel to form attached fluid on the radiation face of the radiant panel, whereby the dew condensation on the radiation face of the radiant panel can be prevented.

According to this embodiment, if at least the heat exchanger, the radiant panel and the evaporator are mounted in an indoor unit, and the other equipments are mounted in an outdoor unit, a separation type air conditioner which can perform the radiative cooling and heating operation can be provided.

Furthermore, according to this embodiment, if the outdoor unit is connected to plural indoor units, a multiroom type air conditioning system which can air-condition many rooms at the same time can be provided. In addition, the radiant panel can be continuously driven for a long time, and thus the radiation type air conditioning system can be efficiently operated.

What is claimed is:

1. A radiation type air conditioning system for supplying a radiant panel having a radiation face with fluid which is cooled or heated through heat exchange, and cooling or heating a room with radiant heat of the cooled or heated fluid through the radiation face of the radiant panel, including:

air cooling means for cooling air through heat exchange; and dew-condensation preventing air supply means for supplying the heat-exchanged cooled air to the periphery of said radiation face of said radiant panel to prevent occurrence of dew condensation on said radiation face of said radiant panel.

2. The radiation type air conditioning system as claimed in claim 1, further including heating means for heating the air which has been cooled by said air cooling means.

3. The radiation type air conditioning system as claimed in claim 1, further including a refrigeration circuit comprising a compressor, a condenser, an expansion device, a heat exchanger, a radiant panel and an evaporator, wherein the cooled or heated fluid is refrigerant circulating in the refrigeration circuit, and the room is cooled or heated with the radiant heat of the cooled or heated refrigerant through said radiant panel.

4. The radiation type air conditioning system as claimed in claim 3, wherein said air cooling means comprises said evaporator constituting said refrigeration circuit.

5. The radiation type air conditioning system as claimed in claim 3, further including an air blower for blowing air to said evaporator and said heat exchanger in this order, a bypass circuit through which the refrigerant bypasses said heat exchanger and/or said evaporator of said refrigeration circuit, and switch means for switching said bypass circuit.

6. The radiation type air conditioning system as claimed in claim 5, further including control means for allowing the refrigerant to flow into said heat exchanger, said radiant panel and said evaporator to cool the air and circulating the cooled air in the room by said air blower to convectively cool the room when room cooling operation is started, allowing the refrigerant to flow into said radiant panel while bypassing said heat exchanger and said evaporator to cool the room with the radiant heat from said radiant panel when a room temperature reaches a predetermined temperature, and allowing the refrigerant into said heat exchanger, said radiant panel and said evaporator while operating said heat exchanger to heat the air cooled by said evaporator to generate dried and heated air and blowing the dried and heated air onto said radiation face of said radiant panel by said air blower to prevent occurrence of dew condensation on said radiation face of said radiant panel.

7. The radiation type air conditioning system as claimed in claim 5, wherein at least said heat exchanger, said radiant panel and said evaporator are mounted in an indoor unit, and the other elements are mounted in an outdoor unit.

8. The radiation type air conditioning system as claimed in claim 7, wherein a plurality of indoor units each having at least said heat exchanger, said radiant panel and said evaporator to said outdoor unit so that said outdoor unit and each of said indoor units constitute a refrigeration circuit, whereby a multiroom air conditioning system is established.

9. The radiation type air conditioning system as claimed in claim 1, wherein said dew condensation preventing air supply means has plural through holes through which the air cooled by said air cooling means flows, said plural through holes being formed in said radiant panel in a thickness direction of said radiant panel, and an air blower for blowing the cooled air through the through holes to the periphery of said radiation face of said radiant panel at the room side.

10. The radiation type air conditioning system as claimed in claim 9, further including room-air taking means for taking the indoor air from the room to blow the indoor air to said radiant panel, and a control mechanism for controlling the intake of the indoor air from the room when the indoor air is blown to said radiant panel, thereby varying an amount of air to be blown out to the room through the through holes.

11. The radiation type air conditioning system as claimed in claim 10, wherein said control mechanism controls the intake of the indoor air on the basis of the temperature difference between the temperature of the room and a required temperature.

12. The radiation type air conditioning system as claimed in claim 10, wherein said control mechanism controls the intake of the indoor air on the basis of the humidity in the room.

13. The radiation type air conditioning system as claimed in claim 9, further including a refrigeration circuit comprising a compressor, an outdoor heat exchanger, an expansion valve and an indoor heat exchanger, wherein the cooled or heated fluid is air which is heat-exchanged by said indoor heat exchanger, and the cooled or heated air is supplied into said radiant panel by said air blower to cool or heat the room with the radiant heat of the cooled or heated air through said radiant panel.

14. The radiation type air conditioning system as claimed in claim 12, wherein said indoor heat exchanger comprises an evaporator.

15. The radiation type air conditioning system as claimed in claim 14, further including a condenser for drying which is provided at a downstream side of said evaporator.

16. The radiation type air conditioning system as claimed in claim 13, wherein said through holes are formed in said radiation face of said radiant panel.

17. The radiation type air conditioning system as claimed in claim 13, wherein at least said radiant panel and said evaporator are mounted in an indoor unit, and the other elements are mounted in an outdoor unit.

18. The radiation type air conditioning system as claimed in claim 17, wherein a plurality of indoor units each having at least said radiant panel and said evaporator to said outdoor unit so that said outdoor unit and each of said indoor units constitute a refrigeration circuit, whereby a multiroom air conditioning system is established.

* * * * *